US006205832B1

(12) United States Patent
Köstermeier

(10) Patent No.: US 6,205,832 B1
(45) Date of Patent: Mar. 27, 2001

(54) FLOW-FORMING METHOD AND APPARATUS

(75) Inventor: Karl-Heinz Köstermeier, Rietberg (DE)

(73) Assignee: Leico GmbH & Co. Werkzeugmaschinenbau, Ahlen (DE)

( * ) Notice: Subject to any disclaimer, the term of this patent is extended or adjusted under 35 U.S.C. 154(b) by 0 days.

(21) Appl. No.: 09/450,122

(22) Filed: Nov. 26, 1999

(30) Foreign Application Priority Data

Nov. 25, 1998 (DE) ..... 198 54 481

(51) Int. Cl.[7] ..... B21D 22/16
(52) U.S. Cl. ..... 72/83; 72/85
(58) Field of Search ..... 29/893.32; 72/83, 72/85, 96

(56) References Cited

U.S. PATENT DOCUMENTS 5,384,949 * 1/1995 Wodrich et al. ..... 72/84

FOREIGN PATENT DOCUMENTS 42 18 092 6/1993 (DE) .

* cited by examiner

*Primary Examiner*—Lowell A. Larson
(74) *Attorney, Agent, or Firm*—Oblon, Spivak, McClelland, Maier & Neustadt, P.C.

(57) ABSTRACT

In a flow-forming method, an axially symmetrical first workpiece is fixed on a spinning mandrel, which together with the workpiece is rotated. At least one spinning roll is infed. The workpiece is formed and shaped while on an axially extending external profile of the spinning mandrel. A spacer is mounted on this spinning mandrel. A marginal area of the workpiece is shaped on an area of the spacer, the latter being plastically deformed during the shaping of the marginal area of the workpiece. Also, a flow-forming apparatus has a spinning mandrel on which a workpiece can be fixed, a drive by which the spinning mandrel and workpiece can be rotated together, and at least one spinning roll for shaping the workpiece in a forming area. The deformable spacer has an overlap area. During workpiece shaping, the overlap area at least partly overlaps with the forming area of the workpiece.

16 Claims, 2 Drawing Sheets

FLOW-FORMING METHOD AND APPARATUS

CROSS REFERENCE TO RELATED APPLICATION

This application claims priority from German Patent Application Serial No. 198 54 481.2, filed Nov. 25, 1998, which is incorporated herein by reference.

BACKGROUND OF THE INVENTION

1. Field of the Invention

The invention relates to a flow-forming method in which an axially symmetrical workpiece is fixed at a free end of a spinning mandrel having an external profile; the spinning mandrel together with the workpiece are rotated and at least one spinning roll is infed, said workpiece being shaped to the external profile of the spinning mandrel.

The invention also relates to a flow-forming apparatus with a spinning mandrel having an external profile and on which can be fixed a workpiece, a drive by which the spinning mandrel and the workpiece can be rotated together and at least one spinning roll for shaping the workpiece to the external profile of the spinning mandrel.

2. Description of Related Art

Methods and apparatuses of the same species are adequately known. For example, a cup-shaped starting workpiece is mounted on a spinning mandrel with a substantially cylindrical outer contour and the axially extending edge of the workpiece is shaped initially by radial and/or axial infeeding of a spinning roll to the spinning mandrel. External teeth can be provided on the spinning mandrel so that these external teeth are pressed into the cup-shaped workpiece. In the known methods and apparatuses, it is problematical that, as a result of the action of the spinning roller, considerable forces are exerted on the external teeth of the spinning mandrel so that, during the pressing in of the teeth, high bending stresses and repeated stress reversals occur on the individual tool teeth. After a relatively short time, these stresses can lead to tooth breakage and consequently to the destruction of the spinning mandrel.

In the flow-forming, cup-shaped, internally toothed workpiece, the problem exists that, at the free edge of the workpiece, the teeth are frequently not completely shaped. Thus, workpieces are conventionally worked with a certain axial oversize which must subsequently be dressed by machining.

Rechucking and dressing in a further working machine are disadvantageous. It is particularly problematical that, on the dressed edge of the internal teeth, a burr is left behind, which can hardly be removed mechanically, so that frequent manual deburring is required.

SUMMARY OF THE INVENTION

The object of the invention is to provide a method and an apparatus permitting a geometrically accurate manufacture of workpieces with an internal profile.

The invention is based on a prior art method in that, spaced from the free end of the spinning mandrel, there is mounted thereon a spacing ring or spacer made from a deformable material. On forming a marginal area of a first workpiece, the deformable material is shaped on the spacer. The spacer, during the shaping of the marginal area of the first workpiece, is plastically deformed and work hardened while the deformed and hardened spacer is left for shaping further workpieces on the spinning mandrel.

Thus, during the workpiece forming process, the spacer adapts to the complex play of forces. An inexpensively manufacturable spacer is adapted in an almost optimum manner to the external profile of the spinning mandrel. As a result of the interplay of materials during shaping, the spacer and workpiece firmly engage with one another, so that there is a uniform, rounded edge contour on the face of the workpiece. This rounded edge contour is particularly advantageous with regard to tribological characteristics.

The deformation of the spacer takes place plastically. Following the forming process, the spacer is work-hardened and dimensionally stable. The spacer can be made from the same material as the workpiece. During forming, a hardened and a stable final shape of the spacer is obtained.

The method according to the invention is particularly suitable for shaping the workpiece in an external profile provided on the lateral face of the spinning mandrel. It can be a tooth system or a keyway profile, such as is required for a clutch disk carrier. In one working step, simultaneously the forming area of the workpiece is brought axially and radially into the desired shape and a hardened surface structure is provided in the inner forming area.

Preferably, the spacer is mounted on the spinning mandrel in such a way that it partly covers the teeth with an overlap area which, during the shaping of the workpiece and the deformation of the spacer, is at least partly shaped into the tooth system. Thus, the spacer is given a reliable hold on the spinning mandrel. The tooth system is additionally supported, which significantly increases the tool life.

The method is particularly advantageous in that, as a result of the shaping of the workpiece at the lateral face, there is an axial material flow which is partly decelerated by the face of the spacer. Radially outer material of the workpiece flows further axially and at least partly overflows the spacer so that, through the radial force component applied by the spinning roll or rollers, the spacer is radially deformed. Thus, the outer edge of the finished workpiece is clearly defined by the stop on the face of the spacer, while excess material flows on axially and consequently comes to rest on the outside of the spacer.

Preferably, the spacer is frontally formed with concave depressions and can extend axially by 0.2 to 0.5 mm. As a result, the workpiece material is shaped in such a way towards the spacer that the faces of the resulting internal teeth form a mirror image of the concave depressions of the spacer with a convex or corrugated structure.

The method is further developed in a particularly advantageous manner in that the wall thickness of a material overflow caused by shaping is rolled virtually to zero by further axial advance of the spinning roll. Thus, in an advantageous manner, any material excess present can easily be removed by cutting it off. However, the edges on the tooth system are not affected by such a deburring.

The method according to the invention is particularly advantageous in that, after the removal of the finished workpiece, the method is repeated with the same deformed and dimensionally stable spacer for the purpose of forming a further workpiece. This repetition leads to identically formed or shaped workpieces and working always takes place to an internal shape, which has the ideal contour provided through the first forming process.

It can also be advantageous if simultaneously several spinning rolls act at different points on the workpiece. This action reduces the local loading of the spinning mandrel and consequently also on the tooth systems. The spinning mandrels are also protected due to the lower forces which arise.

The invention builds up on a prior art apparatus in that a deformable spacer is provided, that the spacer is replaceably fixable to the spinning mandrel and that, during the forming of a first workpiece, the spacer is shapable and fixable to the external profile of the spinning mandrel. An overlap area overlaps at least partly with the workpiece area during workpiece shaping. The advantages of the method can be implemented with this apparatus according to the invention. The spacer can be simply and inexpensively manufactured. It can be replaced easily when changing the axial workpiece length.

It is particularly advantageous to place a pressing disk for fixing the workpiece so as to face the front of the spinning mandrel. As a result, the workpiece can be received in an advantageous manner by the spinning mandrel and it can be given an adequate hold so as to withstand the forces which occur.

The spinning mandrel preferably has a shaping area with a first diameter and a rear area with a second diameter, the first diameter being larger than the second diameter. Thus, the spinning mandrel can be fixed in a driven receptacle, while the shaping area diameter is adapted to the workpiece to be produced.

The shaping area of the spinning mandrel has a tooth system as the external profile, so that the forming process shapes an internal tooth system into the workpiece.

The spacer preferably has an overlap area with a first internal diameter and a rear area with a second internal diameter, the spacer with its overlap area resting on the shaping area of the spinning mandrel and with its rear spacer area resting on the rear area of the spinning mandrel. As a result, a clearly defined position on the spinning mandrel is associated with the spacer. In addition, the overlap area has a reduced thickness so that here the necessary deformation of the spacer can take place in a particularly advantageous manner. It is advantageous in this connection if, at its rear area, the spacer is axially fixed between an edge, which is in the form of a radial undercut between the shaping area and the rear area of the spinning mandrel, and the face of the driven receptacle. Thus, the spacer has a reliable hold throughout the method sequence.

In an undeformed state, the spacer has a substantially axially constant external diameter which is smaller than the external diameter of the workpiece when the workpiece and spacer come into contact for the first time. This contact makes it possible through the axial advance of the spinning roll to allow material to flow from the radially outer workpiece area over the spacer, whereas the material flow in the further inwardly located area of the workpiece is decelerated by the spacer face.

In the apparatus according to the invention, in the deformed state of the spacer, the latter is at least partly shaped with its overlap area in the tooth system and has a concave outer contour tapering towards the edge of the overlap area. This shape provides an optimum configuration for the following forming processes so that the tooth system is effectively supported.

Preferably, there are several spinning rolls, thus reducing the loading of the individual spinning rolls. In addition, the local loading of the spinning mandrel and the tooth system is reduced.

It is particularly advantageous to arrange the spinning rolls in a circular manner around the spinning mandrel and to mount them in a rotary manner inside a cage. As a result of this configuration, the force is symmetrically transferred in a uniform manner to all the rolls, so that simultaneously they act in the forming process and uniformly load the inner spinning mandrel.

The invention is based on the surprising finding that, through the provision of an initially deformable spacer, a particularly advantageous and geometrically accurate forming process is possible. The tool, with the spacer as a part thereof, automatically adapts to the existing play of forces so that there are ideal conditions for a forming process. Moreover, through an adaptation of the spacer to the workpiece, a deburring of the front tooth edges is avoided, so that there is a virtually finish-formed workpiece as a result of the inventive method. When suitable materials and method conditions are chosen, it is possible to use a spacer for the production of about one thousand workpieces. The spacer can then be removed and replaced by an undeformed spacer. As a result of the same measure, namely the provision of a spacer, the spinning mandrel teeth are supported, which reduces significantly the bending of the tooth system and consequently increases the life of the tool chuck.

BRIEF DESCRIPTION OF THE DRAWINGS

The invention is described in greater detail hereinafter relative to an exemplified embodiment and with reference to the attached drawings, wherein.

DETAILED DESCRIPTION OF THE INVENTION

Figure 1:
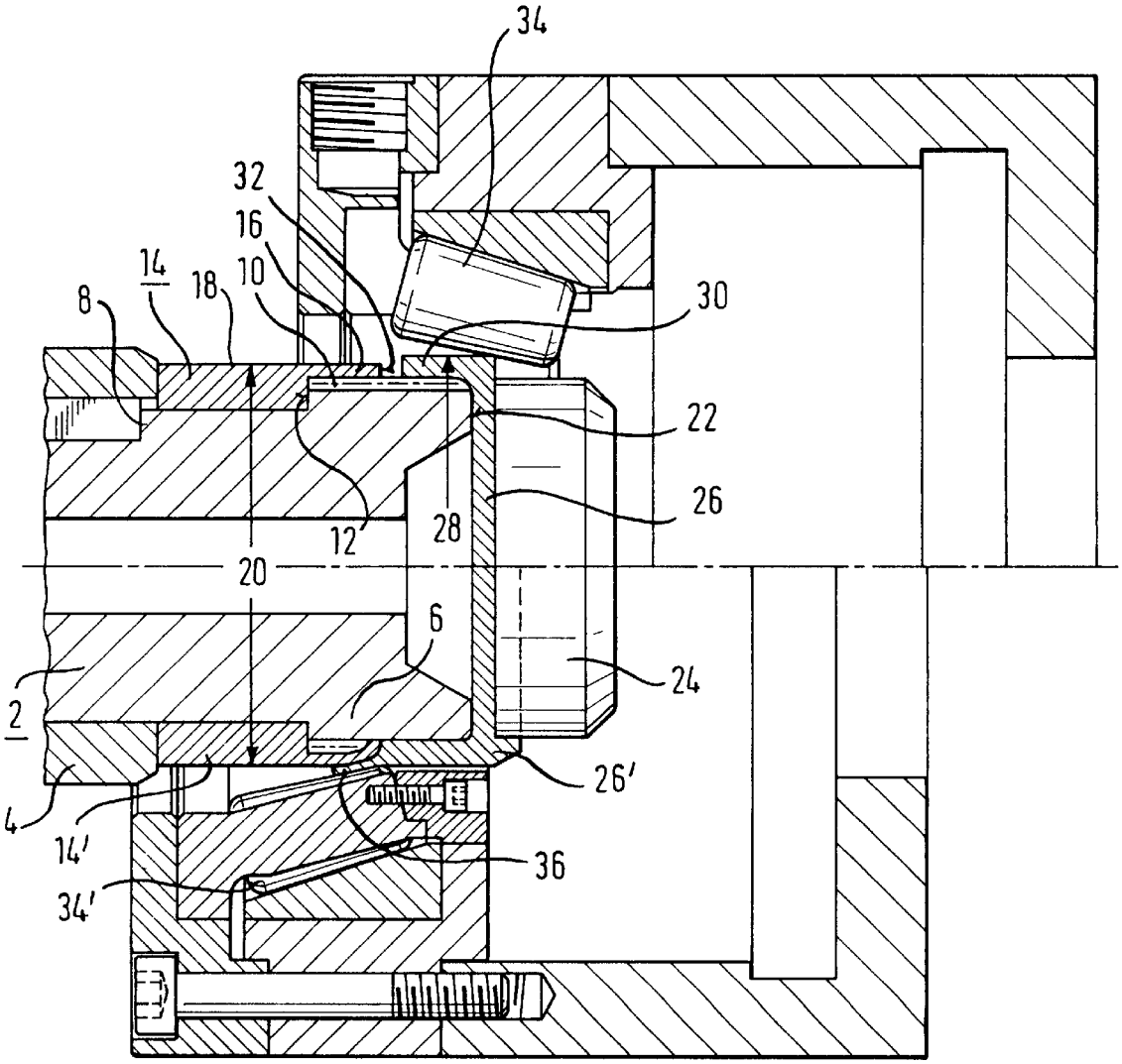
FIG. 1 is a sectional view of an inventive apparatus during two different method stages.

FIG. 1 shows an apparatus according to the present invention. In the upper area, there is shown the apparatus during an early method stage, whereas the lower area shows a later stage.

A spinning mandrel 2 is held in a driven receptacle 4. The spinning mandrel 2 has a shaping area 6 and a rear area 8 which has a smaller diameter than the shaping area 6, the latter being provided with a tooth system 10. As a result of the different diameters of the shaping area 6 and the rear area 8, a radially extending edge 12 occurs at the transition between the areas 6 and 8.

A spacer or spacing ring 14 is mounted on the spinning mandrel 2. The spacer 14 has an overlap area 16 and a rear area 18. The rear area 18 rests on the rear area 8, while the overlap area 16 overlaps the tooth system 10 of the shaping area 6. Thus, the spacer 14 is appropriately adapted to the outer contour of the spinning mandrel 2. The rear area 18 is axially fixed between the edge 12 and the driven receptacle 4 so that a secure hold is provided for the spacer 14. In its undeformed state, the spacer 14 has a substantially axially constant external diameter 20. A first workpiece 26 is fixed by a pressing disk 24 against the face 22 of the spinning mandrel 2. In the present case, the workpiece 26 is cup-shaped and has an external diameter 28 larger than the external diameter 20 of the spacer 14. The workpiece 26 can be shaped in the same setting from a circular blank.

In the upper area of FIG. 1, there is shown an initial method stage during which, between an axially extending collar 30 of the workpiece 26 and the face of the overlap area 16 of the spacer 14, a gap is provided. As a result of the axial advance of spinning rolls 34, there is an axial material flow which is limited if the material comes into contact with a face 32 of the overlap area 16 of the spacer 14. The radially outer material area of the collar 30 of the workpiece 26 can, as a result of further axial advance of the spinning rolls 34, flow axially farther and consequently partially cover the overlap area 16 of the spacer 14. As soon as the action of the radial force component of the spinning roll 34 comes to bear on the overlap area 16 of spacer 14, the latter starts to radially expand into the gaps between the teeth in the tooth system 10 of the spinning mandrel 2. The external diameter 20 of the spacer 14 becomes smaller in the radial force action area. The material of the overlap area 16 of spacer 14 expands to a limited extent, i.e. 0.2 to 0.5 mm in the axial direction and acquires a partly concave or corrugated contour.

The lower area of FIG. 1 illustrates a state in which a spacer 14' is deformed and the material of a first workpiece 26' has axially overflowed, so that a thin burr 36 has formed. Otherwise, there is a finished workpiece 26', where an internal tooth system has been shaped into the external tooth system 10 of the spinning mandrel 2. As in the case of the spacer 14, the spacer 14' has been shaped ideally in accordance with the forming process and easy deburring is possible. The contour on the tooth system 10 does not require remachining. Following this step, the first workpiece 26 or 26' can be removed from the apparatus and a further workpiece can be processed with the already deformed spacer 14'.

Figure 2:
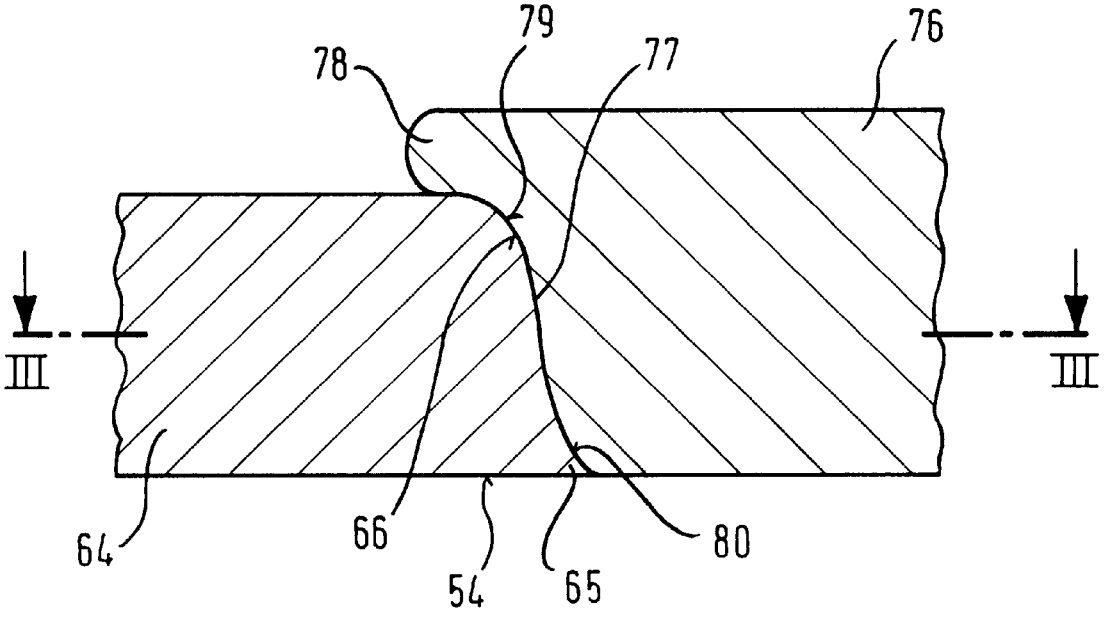
FIG. 2 is a diagrammatic longitudinal cross-section through a tooth of an inventively formed workpiece with a neighboring spacer.
Figure 3:
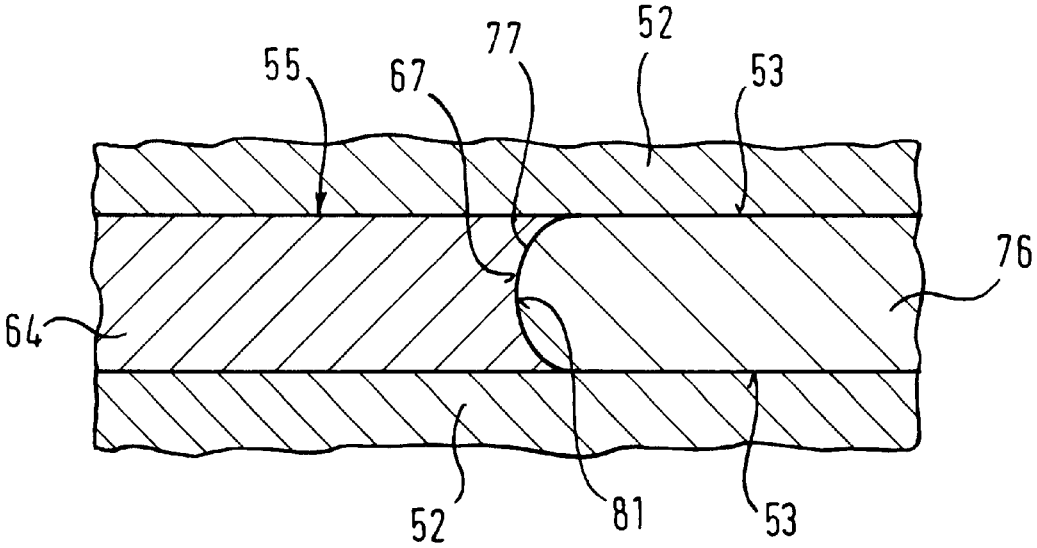
FIG. 3 is a sectional view along line III—III of FIG. 2.

FIGS. 2 and 3 show the rounded edge construction at the face of a workpiece 76 and the corresponding construction of a formed spacer 64. On a spinning mandrel 52, there is partly shown in FIG. 3 a substantially axially directed tooth groove 55 which is bounded by a tooth gullet 54 in FIG. 2 and by tooth flanks 53 in FIG. 3. During the radial shaping of the workpiece 76, due to the frictional effects on the tooth gullet 54 and the tooth flanks 53 in the tooth groove 55, there is a nonuniform material flow. The further removed the workpiece 76 is from the gullet 54 and the flanks 53, the more the material advances axially. Thus, a radially outer material area first reaches a spacer 64 which, in accordance with the forming forces, is also shaped into the tooth grooves 55 of the spinning mandrel 52.

As seen in FIG. 2, a rounding 66 is formed at a radially outer edge. There is also a certain axial material flow of the spacer 64 towards the workpiece 76. The material of the spacer 64 fills the free spaces in the tooth groove 55 of FIG. 3, not yet taken up by the workpiece 76. This flow means that the spacer 64 arcuately leads at the tooth gullet 54 in FIG. 2 and forms a toe 65. Correspondingly, the material of the spacer 64 advances along the tooth flanks 53 in FIG. 3 so that a concave shape 67 is obtained.

At the end of the forming process, a specific or characteristic face contour has formed between the spacer 64 and a face 77 of the workpiece 76. In a longitudinal section shown in FIG. 2, there is an arcuate contour in the form of a mirror inverted S with a foot radius 79 and a head radius 80.

In a cross-section in the circumferential direction according to FIG. 3, it is possible to see a convex arcuate shape 81 on the face 77 of the workpiece 76. This convex arcuate shape 81 is the counterpart of the concave shape 67 of the spacer 64 in the tooth groove 55.

This characteristic contour, not known in existing internally toothed gear parts and located on the face 77 of the workpiece 76, surprisingly has excellent characteristics for a toothed gear part with regards to the edge course and wear. It may merely be necessary on the workpiece 76 to dress a material excess 78 shown in FIG. 2 on the outer circumference, while the previously described contour remains on the face 77 of the workpiece 76.

Numerous modifications and variations of the present invention are possible in light of the above teachings. Thus, it is to be understood that, within the scope of the appended claims, the invention may be practiced otherwise than as specifically described herein.

What is claimed is:

1. Method for flow-forming, in which an axially symmetrical first workpiece is fixed at a free end of a mandrel having an external profile being a toothed system, said method comprising the steps of:

mounting a deformable material spacer on the mandrel and spacing said spacer from the free end of the mandrel;

rotating the mandrel together with the first workpiece;

infeeding at least one spinning roll to form and shape the first workpiece at the external profile of the mandrel;

shaping a marginal area of a first workpiece on the spacer;

deforming plastically and work-hardening the spacer during the shaping of the marginal area of the first workpiece;

removing the first workpiece from the mandrel; and leaving the deformed and work-hardened spacer on the mandrel for forming further workpieces.

2. Method according to claim 1, wherein the first workpiece is shaped at the mandrel having the toothed system with axially directed grooves.

3. Method according to claim 1, further comprising the steps of:

mounting the spacer on the mandrel in such a way that the spacer at least partly covers axially the external profile with an overlap area;

shaping the overlap area into the external profile during shaping of the marginal area of the first workpiece; and limiting axial material flow during shaping of the marginal area of the first workpiece.

4. Method according to claim 1, further comprising the step of:

advancing axially the at least one spinning roll to form and shape the first workpiece.

5. Method according to claim 1, further comprising the step of:

constructing the spacer frontally with concave depressions.

6. Method according to claim 1, further comprising the step of:

distributing uniformly and simultaneously several spinning rolls over a circumference of the first workpiece for engagement with the first workpiece.

7. Apparatus for flow-forming, comprising:

a mandrel having an external profile on which a first workpiece can be fixed;

a drive by which the mandrel can be rotated together with the first workpiece;

at least one spinning roll configured to form and shape the first workpiece on the mandrel; and a deformable spacer fixed on the mandrel and shaped to the external profile thereof during forming and shaping of the first workpiece.

8. Apparatus according to claim 7, further comprising:

a pressing disk positioned to face a front of the mandrel so that the first workpiece can be fixed on the mandrel.

9. Apparatus according to claim 7, wherein the mandrel has a front shaping area with a first diameter and a rear spinning area with a second diameter, said first diameter being larger than the second diameter.

10. Apparatus according to claim 9, wherein the front shaping area of the mandrel includes a toothed system.

11. Apparatus according to claim 10, wherein the deformable spacer in an undeformed state is at least partly shaped with the overlap area into the toothed system and has a concave outer contour tapering towards an edge of the overlap area.

12. Apparatus according to claim 9, wherein the deformable spacer has a front overlap area with a first internal diameter and a rear nonoverlap area with a second internal diameter, said overlap area resting on the shaping area of the mandrel and said nonoverlap area resting on the spinning area of the mandrel.

13. Apparatus according to claim 12, further comprising:

a driven receptacle for the mandrel, said receptacle having a face;

wherein the deformable spacer is axially fixed at its nonoverlap area between an edge, which is a radial undercut between the shaping area and the spinning area, and the face of the driven receptacle.

14. Apparatus according to claim 7, wherein the deformable spacer in an undeformed state has a substantially constant external axial diameter which is smaller than an external diameter of the first workpiece when the spacer and the workpiece first come into contact.

15. Apparatus according to claim 7, wherein said at least one spinning roll includes several spinning rolls.

16. Apparatus according to claim 15, further comprising:

a cage in which the several spinning rolls are mounted in a circular manner around the mandrel for rotary movement.

* * * * *